United States Patent [19]

Mellen

[11] 4,278,497

[45] Jul. 14, 1981

[54] SUCTION DEWATERING SYSTEM WITH AUTOMATICALLY ADJUSTING SUCTION SLOT

[75] Inventor: Jerre L. Mellen, Glens Falls, N.Y.

[73] Assignee: Albany International Corp., Menands, N.Y.

[21] Appl. No.: 121,400

[22] Filed: Feb. 14, 1980

[51] Int. Cl.[3] ..... D21C 1/48; D21C 1/52

[52] U.S. Cl. ..... 162/252; 162/352; 162/366; 162/374; 15/306 A; 34/160

[58] Field of Search ..... 162/252, 363, 364, 366, 162/374, 352; 210/406; 15/302, 306 A, 415 R; 34/43, 92, 155, 160

[56] References Cited

U.S. PATENT DOCUMENTS

| | | | |
|---|---|---|---|
| 2,142,711 | 1/1939 | Birch | 15/306 A |
| 3,520,775 | 7/1970 | Truya | 162/352 |
| 3,836,428 | 9/1974 | McConaughy | 162/374 |
| 3,928,125 | 12/1975 | Poeschl | 162/352 |
| 4,225,991 | 10/1980 | Bolton et al. | 15/306 A |

*Primary Examiner*—S. Leon Bashore
*Assistant Examiner*—Steve Alvo
*Attorney, Agent, or Firm*—Kane, Dalsimer, Kane, Sullivan & Kurucz

[57] ABSTRACT

A suction dewatering system which includes a suction device adapted to be connected to a source of suction and having at least one longitudinal opening therein to which suction can be applied. The opening is positioned substantially perpendicular to the direction of medium travel across the suction device for dewatering thereof. An adjustable slot cover is provided for the suction device and includes a base. The base is mounted to the suction device in fixed position and has surfaces thereon forming spaced longitudinal lands and defining a longitudinal slot between each pair of adjacent lands in alignment with the suction device opening. A wear strip is removably positioned on each of the lands for engagement with the medium passing thereover. The wear strip on one of each pair of adjacent lands is stationary in respect to the direction of medium travel and the wear strip on the other of the pair of adjacent lands is automatically adjustable with respect to the direction of medium travel. Controls are responsive to change in medium conditions traveling over the suction device and automatically adjust the position of the adjustable wear strip and vary the slot width accordingly. One of the land and the adjustable wear strip mounted thereon has an oblique slot therein angularly directed with respect to the longitudinal slot and the other of the land and adjustable wear strip thereon has a rail extending therefrom at an oblique angle with respect to the longitudinal slot and extending into the oblique slot so that when the adjustable wear strip is moved longitudinally it will be shifted laterally with respect to the slot thereby changing the width of the slot opening.

7 Claims, 2 Drawing Figures

SUCTION DEWATERING SYSTEM WITH AUTOMATICALLY ADJUSTING SUCTION SLOT

BACKGROUND OF THE INVENTION

In many types of industrial dewatering systems mediums such as papermaker's felts, require dewatering periodically during use. For this purpose, a variety of different types of suction dewatering systems have been developed including those which employ suction boxes or suction pipes. The pipes or boxes include a slot structure with an upper wear surface over which the medium such as a felt passes into alignment with a slot subjected to a source of suction. Water is drawn by the suction force from the felt as it passes over the slot and is collected in the box or pipe and then is disposed of in a conventional manner.

In use, as the felt or similar material ages it undergoes a physical change whereby parameters such as permeability are changed. A decrease in permeability, for example, causes a greater resistance to dewatering with increased age of the medium. Thus, the dewatering system requires modification as the felt ages in order to maintain an acceptable efficiency in the dewatering procedure. A number of different criteria are used to keep the dewatering process at acceptable efficiency level. One acceptable way of achieving the desired dewatering result as the felt ages is to increase the slot width. This provides for greater exposure of the felt to the suction force as it passes over the slot as well as increasing the dwell time of the felt over the slot and accordingly the time during which it is subjected to the vacuum and water is removed.

Presently known systems employ various acceptable manual procedures for changing slot width such as the system disclosed in U.S. Pat. No. 3,836,428. In this type of system, the manual changing of the slot size is achieved by changing the shape and configuration and sizes of portions of the slot cover. This system works effectively for the purposes discussed above, however, it does result in an interruption in the dewatering process. Naturally in a manual system, the changing process causes the dewatering rate to drop off until the slot opening is manually changed. Of course during the actual changing time the machine is not operating at all and accordingly no dewatering is taking place.

Therefore, further improvements in suction dewatering systems are desirable particularly a system which will automatically adjust the slot size as the felt or similar medium ages without requiring the felt to be periodically checked to determine if it is operating efficiently and without the need of shutting down the machine to manually adjust slot sizes by changing slot cover configurations.

It should also be kept in mind that the manually adjustable systems require an abrupt change in slot size rather than a gradually changing automatic adjustment. Any type of manual system that would utilize gradual change would require frequent manual slot adjustments causing frequent interruption in the use of the machinery.

SUMMARY OF THE INVENTION

With the above background in mind, it is among the primary objectives of the present invention to provide a suction dewatering device with a suction pipe cover which is automatically adjustable in terms of the suction slot for dewatering of a medium such as a papermaker's felt.

The device is designed so that the cover has a stationary strip in terms of the felt direction and one or more automatically adjustable strips in terms of the felt condition. The adjustable strip or strips maintain a particular slot size at the beginning of the life of the medium to be dewatered and would gradually and automatically increase the slot size as the age of the medium increases. A control system senses the vacuum level in the suction device and as it increases, as it normally will over the life of the medium, the control system operates to reposition the adjustable strip and form a larger slot. This process happens simultaneously and would constantly maintain an optimum vacuum level and at the same time increase the dwell time of the medium over the suction area.

With the automatically adjustable slot of the present invention, a felt direction slot size adjustment is achieved without the necessity of removing the slot cover. Also, the automatic slot change coincides with the vacuum level in the suction device to thereby maintain optimum efficiency in the system continuously monitored over the life of the felt or similar medium. Additionally, vacuum pump requirements are minimized since dewatering efficiency is maintained at the highest possible level throughout the felt life. Thus, capital cost, and other equipment savings are readily achieved.

In summary, a suction dewatering system is provided including a suction device adapted to be connected to a source of suction and having at least one longitudinal opening therein to which suction can be applied and the opening being positioned substantially perpendicular to the direction of medium travel across the suction device for dewatering thereof. A cover is provided and includes a base designed to be mounted to the suction device in fixed position. Surfaces on the base form spaced longitudinal lands and define a longitudinal slot between each pair of adjacent lands in alignment with the suction device opening. A wear strip is removably positioned on each of the lands for engagement with the material passing thereover. At least one of the wear strips is automatically adjustable with respect to the direction of material travel. Controls are responsive to a change in medium conditions which results in automatic adjustment of the position of the adjustable wear strip and variance in the slot width accordingly.

In one embodiment of the invention, a pair of adjacent lands are provided with a longitudinal slot therebetween. The wear strip on one of the pair of adjacent lands is stationary with respect to the direction of medium travel and the wear strip on the other of the pair of adjacent lands is automatically adjustable with respect to the direction of medium travel.

One of the land and the adjustable wear strip mounted thereon has an oblique slot therein angularly directed with respect to the longitudinal slot and the other of the land and the adjustable wear strip thereon has a rail extending therefrom at an oblique angle with respect to the longitudinal slot. The rail extends into the oblique slot so that when the adjustable wear strip is moved longitudinally it will be shifted laterally with respect to the slot thereby changing the width of the slot opening.

With the above objectives among others in mind, reference is made to the attached drawings.

DETAILED DESCRIPTION

Figure 1:
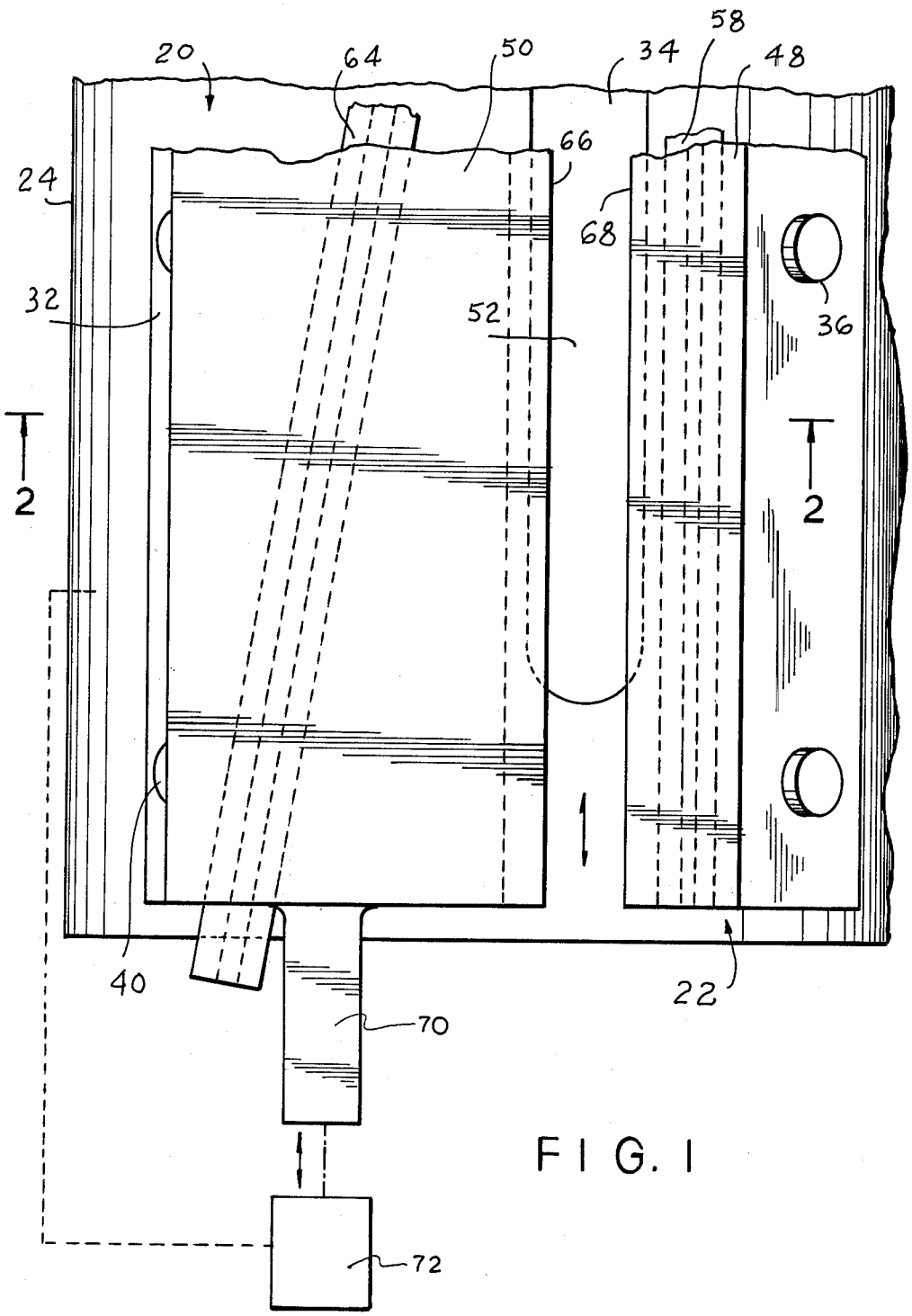
FIG. 1 is a fragmentary top plan view of the suction dewatering system of the invention.

In general, the suction dewatering system 20 of the present invention is similar to that disclosed in U.S. Pat. No. 3,836,428 and in copending applications Ser. No. 100,617 filed Dec. 6, 1979 and Ser. No. 100,814 filed Dec. 6, 1979. The subject matter of the above patent and applications is incorporated herein by reference.

The area of improvement of the present invention resides in the structure of the cover 22 of the suction dewatering system 20. The cover structure 22 is mounted to a well known type of suction pipe 24 having a hollow interior 26 connected at one end to a source of suction in a conventional manner (not shown). Pipe 24 has a longitudinal slot 28 in its upper surface portion communicating with the hollow interior 26 and accordingly subjected to the same source of suction. Cover 22 is mounted to pipe 24 so that it is in predetermined alignment with respect to longitudinal slot 28. In the depicted embodiment of FIGS. 1 and 2, the cover 22 includes a pair of spaced lands 30 and 32 which extend along the length of pipe 24 at least as long as the length of longitudinal slot 28. Lands 30 and 32 are spaced from one another to provide a longitudinal opening 34 therebetween in alignment with slot 28 and in communication therewith. Land 30 is mounted to pipe 24 in fixed position in a conventional manner such as by the use of spaced threaded bolts 36 threadedly interengaged with threaded apertures 38 in the pipe. In a similar manner, land 32 is mounted in fixed position on pipe 24 by means of bolts 40 threaded into threaded apertures 42 of the pipe. As shown, bolts 40 and 36 are spaced along the length of lands 32 and 30 respectively to anchor the lands along the length of pipe 24.

An elongated stationary wear strip 44 is removably mounted on land 30 and an elongated adjustable wear strip 46 is removably mounted on land 32. The upper surface 48 of wear strip 44 forms a wear surface for a medium to be passed thereacross such as a papermaker's felt for dewatering purposes. The upper surface 50 of adjustable wear strip 46 forms a similar surface for the medium. The wear strips 44 and 46 are spaced from one another to provide an aperture 52 therebetween in alignment with opening 34 and slot 28 to provide the continuous longitudinal slot for communication between the interior 26 of pipe 24 and the upper surface of the device 20 so that suction applied therethrough will dewater the medium passing across wear surfaces 48 and 50 and over opening 52 therebetween.

Wear strip 44 is mounted to the upper surface of land 30 by means of an I-shaped anchor member 54. Anchor member 54 is positioned so that the T-shaped bottom portion 56 is positioned in a similar mating T-shaped recess in the upper portion of land 30 and the other T-shaped half 58 of the anchor member 54 is positioned in a mating T-shaped recess in the undersurface of wear strip 44. Wear strip 44 is positioned on upper portion 58 of the anchor member by sliding it on from one end and can be removed in the same manner. Once mounted as shown in FIGS. 1 and 2 wear strip 44 is in fixed position with respect to the direction of travel of the medium thereacross as shown by arrows in FIG. 2.

Adjustable wear strip 46 is positioned on the upper surface of land 32 and in the embodiment shown is of greater width than the stationary wear strip 44. Removable mounting of the wear strip is accomplished by means of I-shaped anchor member 60 which has a bottom T-shaped portion 62 mounted in conventional fashion in an accommodating mating recess in the upper surface of the land 32. The upper T-shape portion 64 of anchor member 60 is positioned in a mating recess in the underportion of wear strip 46. The recesses in the wear strip 46 and land 32 are formed to provide an angular slot with respect to longitudinal slot 34 between the cover portions so that when the anchor member 60 is positioned in the angularly directed recess it will be at an oblique angle with respect to slot 34. Consequently, sliding of wear strip 46 longitudinally with respect to pipe 24 as shown by the reciprocal arrow in FIG. 1 will cause the wear strip 46 to shift laterally with respect to the opening 52 and slot 34 thus adjusting the distance between the inner surface 66 of adjustable wear strip 46 and the opposing inner surface 68 of the fixed wear strip 44. In this manner it is possible to adjust the suction slot width by adjusting the opening 52. This adjustment occurs in the direction of travel of the medium across the wear strips thus varying the dwell time of the medium with respect to the application of suction. In the depicted embodiment, the upper portion 64 of anchor member 60 forms a rail on which wear strip 46 slides when it is shifted reciprocally in the longitudinal direction. The bottom portion 62 of anchor member 60 is fixed in position on land 32. Naturally, it will be equally acceptable to make portion 62 a slidable rail in an accomodating recess in land 32 and conventionally fix portion 64 in the recess in the undersurface of movable wear strip 46. Naturally, the number of shiftable wear strips and fixed wear strips is a matter of choice with the overall objective being to provide for adjustment of the slot width and accordingly the dwell time of the moving medium with respect to the suction slot.

Adjustable wear strip 46 has a projecting arm 70 extending from one end thereof for engagement with a conventional control means 72 which can be electrically, pneumatically or otherwise conventionally actuated to reciprocate projecting portion 70 and accordingly wear strip 46 for adjustment.

Figure 2:
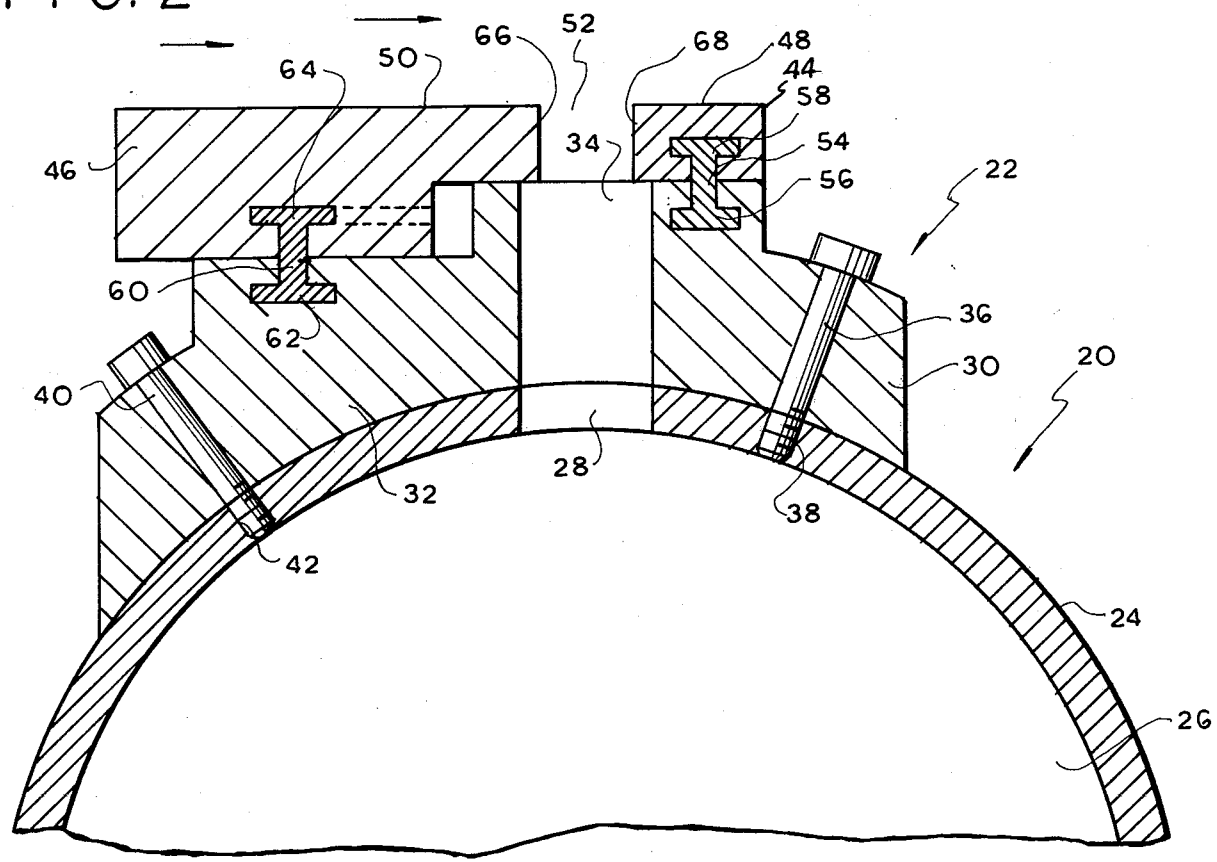
FIG. 2 is a sectional view thereof taken along the plane of line 2—2 of FIG. 1.

In use, a medium such as a papermaker's felt is arranged to pass laterally over the suction dewatering system 20 in the direction of the arrow of FIG. 2. When the medium is new it has a greater permeability and is less resistant to air flow. With this in mind, in the present system, it is desirable to have opening 52 as small as possible. Accordingly, control means 72 is used to shift projecting arm portion 70 and accordingly adjustable wear strip 46 in FIG. 1 longitudinally away from the controls as shown by the arrow causing inner surface 66 of strip 46 to shift laterally making opening 52 smaller. This is accomplished by wear strip 46 moving angularly along oblique rail 64.

During use, the medium develops reduced permeability thus increasing resistance to air flow. Accordingly, the vacuum in pipe 24 increases. This increase in vacuum is monitored and sensed in a conventional manner by the control means 72 which automatically continuously or intermittently reciprocates arm 70 longitudinally in the opposite direction toward the controls as shown by the arrow in FIG. 1. This causes wear strip 46 to travel along oblique rail portion 64 and laterally move inner surface 66 of the wear strip away from inner surface 68 of stationary wear strips 44. This widens slot opening 52 and accordingly increases the slot size. Therefore, as the dewatered medium becomes more resistant to air flow with increased age, the increased slot size increases the exposure or dwell time of the medium to the vacuum area providing for improved dewatering over the lifetime of the felt. This is accomplished in an automatic manner by appropriate mechanical, electrical or pneumatic controls as part of the conventional control system 72.

Suction dewatering device 20 with one or more stationary wear strips 44 and one or more adjustable wear strips 46 is automatically adjustable in terms of the felt direction of travel. The adjustable strip or strips maintain a particular slot size at the beginning of the life of the medium to be dewatered and gradually and automatically increase the slot size as the age of the medium increases. A conventional control system 72 senses the vacuum level in the suction device and as it increases, as it normally will over the life of the medium, operates projecting arm 70 to reposition adjustable strip 46 to form a larger slot. This process happens simultaneously and constantly maintains an optimum vacuum level while at the same time increasing the dwell time of the medium over the suction slot area.

In this manner, slot size adjustment in the direction of felt travel is accomplished without the necessity of removing any portion of the slot cover 22. An automatic slot changing system is provided that coincides with the vacuum level in the suction device 20. With the present system, vacuum pump requirements are minimized thereby providing cost savings.

In the above embodiment, a conventional type of vacuum pump such as a liquid ring pump or any conventional well known substitute therefore can be used for producing the vacuum in the system. It is also conventional to use a centrifugal exhauster for the suction source. If a centrifugal exhauster is used the vacuum level will not increase significantly with a decrease in felt permeability. Therefore, in that embodiment, a conventional type of sensor is used as part of the control system to sense a change in air flow requirements to activate the system and increase the slot width to maintain air flow at essentially a constant vacuum. Otherwise, the system would operate as described in connection with the above embodiment.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A suction dewatering system comprising; a suction device adapted to be connected to a source of suction and having at least one longitudinal opening therein to which suction can be applied and the opening being positioned substantially perpendicular to the direction of a material travelling across the suction device for dewatering thereof, a cover including a base, means on said base for mounting the base to the suction device in fixed position, surfaces on said base forming spaced longitudinal lands and defining a longitudinal slot between each pair of adjacent lands in alignment with said suction device opening, a wear strip removably positioned on each of the lands for engagement with the material passing thereover, at least one of the wear strips being automatically adjustable with respect to the direction of material travel, adjustment means responsive to change in material conditions which results in automatic adjustment of the position of the adjustable wear strip and variance in the slot width accordingly, one of the land and the adjustable wear strip mounted thereon having an oblique slot therein and said oblique slot being angularly directed with respect to the longitudinal slot; and the other of the land and adjustable wear strip thereon having a rail extending therefrom at an oblique angle with respect to the longitudinal slot and extending into and mating with the oblique slot so that when the adjustable wear strip is slidably moved longitudinally it will be shifted laterally with respect to the longitudinal slot thereby changing the width of the longitudinal slot opening.

2. The invention in accordance with claim 1 wherein there is a pair of adjacent lands for each longitudinal slot, the wear strip on one of each pair of adjacent lands being stationary in respect to the direction of medium travel and the wear strip on the other of the pair of adjacent lands being automatically adjustable with respect to the direction of medium travel.

3. The invention in accordance with claim 1 wherein the adjustment means senses an increase in vacuum level in the suction device and as it increases during the use life of the material being dewatered it adjusts the position on the adjustable wear strip to form a larger slot, the adjustment occurring simultaneously and constantly with respect to the corresponding change in vacuum level thereby maintaining an optimum vacuum level and at the same time increasing the dwell time of the material over the suction area by widening the slot between the wear strips.

4. The invention in accordance with claim 1 wherein the oblique slot is in the underside of the adjustable wear strip and the rail extends upwardly from the upper surface of the land.

5. The invention in accordance with claim 4 wherein each wear strip is mounted on a land by means of a mounting member having an I-shaped cross section and each land and corresponding wear strips having aligned T-shaped openings inverted with respect to each other which mate to correspond to the mounting member of I-shaped cross section, the T-shaped openings extending substantially the entire length of the lands and wear strips thereby permitting the wear strip to be slid longitudinally onto the fastening member and mounting the wear strip to the land and for removal thereof.

6. The invention in accordance with claim 1 wherein the system includes papermaking machinery with the suction device being a suction pipe and the material to be dewatered is a felt material.

7. The invention in accordance with claim 1 wherein the adjustment means senses a decrease in air flow in the suction device and during the use life of the material being dewatered it adjusts the position on the adjustable wear strip to form a larger slot, the adjustment occurring simultaneously and constantly thereby maintaining essentially a constant air flow or vacuum level and at the same time increasing the dwell time of the material over the suction area by widening the slot between the wear strips.

* * * * *